United States Patent [19]

Yarworth et al.

[11] 4,041,432

[45] Aug. 9, 1977

[54] MOTOR PROTECTOR FOR HIGH TEMPERATURE APPLICATIONS AND THERMOSTAT MATERIAL FOR USE THEREIN

[75] Inventors: Norman Yarworth, Attleboro; Radi Pejouhy, Marshfield, both of Mass.

[73] Assignee: Texas Instruments Incorporated, Dallas, Tex.

[21] Appl. No.: 613,789

[22] Filed: Sept. 16, 1975

[51] Int. Cl.[2] ..... H01H 37/54

[52] U.S. Cl. ..... 337/111; 337/371; 337/379

[58] Field of Search ..... 337/89, 91, 365, 367, 337/370, 371, 379, 111

[56] References Cited

FOREIGN PATENT DOCUMENTS 1,109,494 4/1968 United Kingdom ..... 337/379

*Primary Examiner*—George Harris

*Attorney, Agent, or Firm*—John A. Haug; James P. McAndrews

[57] ABSTRACT

A motor protector for use in motors having a high operating temperature employs a snap-acting composite thermostat element to actuate the protector wherein the multilayer thermostatic material embodied in the element has an electrical resistivity value from 20 ohms/c.m.f. to 400 ohms/c.m.f. and a flexivity value from $90 \times 10^{-7}$ inches per inch per degree Fahrenheit to $110 \times 10^{-7}$ inches per inch per degree Fahrenheit to provide for better calibration, longer life, and better space control in the protector for use in motors having higher operating temperatures.

9 Claims, 2 Drawing Figures

Figure 1:
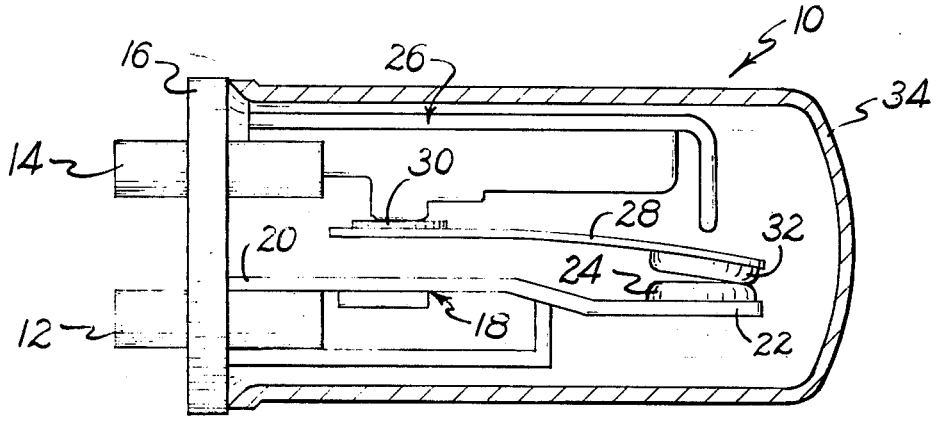

MOTOR PROTECTOR FOR HIGH TEMPERATURE APPLICATIONS AND THERMOSTAT MATERIAL FOR USE THEREIN

BACKGROUND AND SUMMARY OF INVENTION

In motor protector devices, it is customary to use a dish-shaped composite thermostatic element to provide the actuation means for the device. The devices are typically embedded in the windings of a motor to provide inherent protection which senses not only overcurrent conditions but also overtemperature conditions. Both the amount of current flowing through the thermostatic element which provides self-heating and the ambient temperature determine if a fault condition occurs and consequently can cause the element to snap to an inverted dish-shaped configuration moving the contacts of the device apart breaking the circuit.

The temperature at which a composite snap-acting element actuates is determined by the material selection of the composite and the configuration of the dish-shaped deformation. The composite material will have a selected electrical resistivity which determines the heat generated in the element due to the electrical current passing through it and also a selected flexivity which is responsive to heat build up in the disc. This composite material with known properties is then deformed to a dish-shaped configuration, the extent of the dishing determining the temperature at which the disc will snap.

With new motor designs and better insulating materials used in them, higher motor operating temperatures are now achievable which require that motor protector devices also be designed to trip at higher temperatures than previously desired. However, it has been found that motor protectors provided for protecting motors at such higher operating temperatures have been less reliable than would be desired. It is also found that very high rejection rates are encountered in manufacturing motor protectors for such motors.

It has now been found that when snap-acting thermostatic elements are made for such higher temperature motors using conventional thermostat materials, the extent of deformation required to provide a desired high actuating temperature can be excessive and can exceed the failure limit of the material. In some cases where failure limit of the material is exceeded during deformation of the thermostat element, motor protectors incorporating the elements fail to operate at the desired temperature and have to be rejected. In other cases, where the deformation of the element material is less severe but still cause excessive permanent deformation of the material the snap-acting elements initially function at the proper operating temperature, however, these devices can quickly fail due to fatigue problems and lose their calibration. Also at high temperatures, calibration problems in the devices can occur because of the nonlinearity of the thermal response curve for conventional thermostat materials at higher temperatures.

Accordingly, it is an object of the present invention to provide an improved motor protector device for higher operating temperatures.

It is another object of the present invention to provide an improved multilayer composite thermostat material for use in motor protectors especially in high temperature applications.

It is yet another object of the present invention to provide an improved composite thermostat material for use as a snap-acting bimetallic disc which is durable in use, has good corrosion resistance properties and is relatively economical to fabricate.

Figure 2:
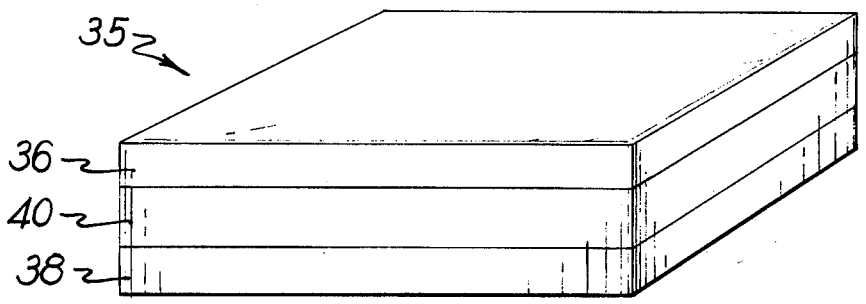

Other objects, advantages, and details of the motor protector device and composite material contained therein provided by this invention appear in the following detailed description of preferred embodiments, the detailed description referring to the drawings in which:

FIG. 1 is a cross-sectional view of a motor protector device for high temperature use provided by this invention; and FIG. 2 is a perspective view of the composite thermostat material of the present invention.

Referring to the drawings, 10 in FIG. 1 illustrates the motor protector of this invention which is especially adapted for use in motors of the type intended for high temperature operation. The motor protector 10 has terminal means such as terminal posts 12, 14 insulatively inserted and secured in a header plate 16. A first stationary contact arm 18 has one end 20 attached to first terminal post 12 and has attached to the other end 22 a stationary contact 24. A heater element 26 is secured to the second terminal post 14 and positioned so as to be in direct heat transfer relationship with a composite thermostatic disc member 28 preferably having a dished portion of the configuration of a segment of a sphere of selected radius. Disc 28 is attached to a flange portion 30 of heater element 26. Affixed at one end of disc member 28 is a movable contact 32 positioned to be engageable with stationary contact 24. A cover 34 is attached to headerplate 16 enclosing the protector except for the end portions of terminals 12, 14 extending through the headerplate. Although FIG. 1 illustrates a specific embodiment of this invention, motor protection of motors is well known and it is to be understood that the term snap-acting thermally-responsive as used herein is to include any device comprising at least two contact members, one of the members being movable relative to the other, and a composite thermostatic dish-shaped metal laminate member which is movable with snap-action in response to thermal motion for causing the movement of the movable contact member relative to the other contact member to open a motor winding circuit.

In accordance with this invention, composite disc member 28 is formed of a novel and improved thermostat metal material particularly adapted for use in high operating temperature overload motor protection devices. That is, composite disc member 28 is formed of a composite metal laminate 35 as shown by FIG. 2 having a first outer layer 36 of a first preselected metallic alloy having a relatively high coefficient of thermal expansion, a second outer layer 38 of a second preselected metallic alloy having a relatively lower coefficient of thermal expansion with respect to the first preselected material, and an intermediate layer 40. In fabrication of the composite thermostat material, the first and second outer layers 36, 38 are metallurgically bonded, preferably solid phase bonded to the opposed surfaces of this intermediate layer 40, the bonds between the respective metallic layers extending substantially throughout the entire contiguous surfaces of the layers defining the composite material 10. It may be noted that the thickness of the composite material 35 may vary from approximately 0.001 inch to 0.100 inch. The illustrated composite thermostat material 10 thus comprises an integral unit adapted to flex in response to temperature changes.

More specifically, composite material 35 used for disc 28 has an electrical resistivity value from 20 ohms/c.m.f. to 400 ohms/c.m.f. and a flexivity value from $90 \times 10^{-7}$ in/in/° F. to $110 \times 10^{-7}$ in/in/° F. For example, first outer layer 36 may be an iron alloy having a nominal composition by weight of about 25 percent nickel, 8.5 percent chromium and the balance iron and having a relatively high coefficient of thermal expansion of about $9.26 \times 10^{-6}$ inches per inch per degree Fahrenheit, second outer layer 38 may be an iron alloy having a nominal composition by weight of 40 percent nickel and the balance iron and having a relatively low coefficient of thermal expansion of about $2.29 \times 10^{-6}$ inches per inch per degree Fahrenheit; and intermediate metal layer 40 may be a copper alloy having a nominal composition by weight of about 99.914 copper and 0.086 percent silver and a coefficient of thermal expansion of about $9.6 \times 10^{-6}$ inches per inch per degree Fahrenheit. Alternatively, if a higher resistivity value is needed layer 40 may be made from nickel. In the thermostat material of this invention, the metal layers 36, 38 preferably each have approximately the same thickness comprising from about 25 to 49 percent of the total thickness of the composite material and metal layer 40 has a thickness comprising 2 to 50 percent of the total thickness of the composite thermostat material.

Accordingly, composite thermostat material is used for the snap-acting disc in motor protector 10 for providing for reliable performance in a device operating in the excess of 280° F. With a nominal value of flexivity of $100 \times 10^{-7}$ inches per inch per degree Fahrenheit, the amount of performing required in fabrication of the snap-acting disc for high temperature trip does not stress the material past its failure limit. Disc 28 can withstand cycling at elevated temperatures without fatigue failure and change in open and close temperature characteristics. On the other hand, conventional materials with similar resistivity values used in high temperature trip devices often require prestressing beyond the failure limit of the material and consequently have a high fatigue rate. The lesser amount of preforming also allows for more compact motor protector design because the space requirement for disc movement is smaller.

In accordance with this invention, composite material 35 is preferably symmetrical about a central axis splitting the thickness of the material in two. The symmetrical configuration maximizes fatigue strength. Also linear response curve for composite thermostat material 35 is linear up to a higher temperature than conventional thermostat materials to provide for better calibration of devices for high temperature use. Lastly, material 35 is stable at sub-zero temperatures for ease in storage and shipping which need not be the case for conventional high expansion alloys for this application.

It should be understood that the embodiments of the motor protector device and thermostat material used therein which have been described above have been described by the way of illustrating this invention and that this invention includes all modifications and equivalents of the described embodiments falling within the scope of the appended claims.

We claim:

1. A composite thermostat material for use in high operating temperature overload protection devices comprising an outer layer of a first preselected metallic alloy having a relatively high coefficient of thermal expansion, a second outer layer of approximately equal thickness of a second preselected metallic alloy having a relatively lower coefficient of thermal expansion than said first preselected metallic alloy and an intermediate layer of a third preselected metallic alloy having a relatively low value of electrical resistivity, said composite having an electrical resistivity value from 20 ohm/c.m.f. to 400 ohm/c.m.f. and a flexivity value from $90 \times 10^{-7}$ inches per inch per degree Fahrenheit to $110 \times 10^{-7}$ inches per inch per degree Fahrenheit.

2. A composite thermostat material as set forth in claim 1 wherein said first preselected metallic alloy has a nominal composition by weight of about 25 percent nickel, 8.5 percent chromium and the balance iron and said second preselected metallic alloy has a nominal composition weight of about 40 percent nickel and the balance iron.

3. A composite thermostat material as set forth in claim 2 wherein said intermediate layer is selected from the group consisting of high copper and nickel alloys.

4. A high operating temperature overload protection device comprising a housing containing at least two contacting members one of said members movable relative to the other, and a snap-acting thermostat metal member having a dished portion adapted to move to an inverted dished configuration when heated to a temperature in excess of 280° F. for causing movement of said movable member, said thermostat member embodying a composite metal laminate material having a first outer layer of a preselected metallic alloy with a relatively high coefficient of thermal expansion, a second outer layer of a preselected metallic alloy of approximately equal thickness with a relatively lower coefficient of thermal expansion, and an intermediate layer of a third preselected metallic alloy with a relatively low value of electrical resistivity, said composite having an electrical resistivity value from 20 ohms/c.m.f. to 400 ohms/c.m.f. and a flexivity value from $90 \times 10^{-7}$ inches per inch per degree Fahrenheit to $110 \times 10^{-7}$ inches per inch per degree Fahrenheit.

5. A high operating temperature overload protection device as set forth in claim 4 wherein said first preselected metallic alloy has a nominal composition by weight of about 25 percent nickel, 8.5 percent chromium and the balance iron and said second preselected metallic alloy has a nominal composition weight of about 40 percent nickel and the balance iron.

6. A high operating temperature overload protection device as set forth in claim 5 wherein said intermediate layer is selected from the group consisting of high copper and nickel alloys.

7. A snap-acting thermostat metal member having a dished portion to move to an inverted dished configuration when heated to a temperature in excess of 280° F., said thermostat metal member embodying a composite metal laminate material having a first outer layer of a preselected metallic alloy with a relatively high coefficient of thermal expansion, a second outer layer of a preselected metallic alloy of approximately equal thickness with a relatively lower coefficient of thermal expansion, and an intermediate layer of a third preselected metallic alloy with a relatively low value of electrical resistivity, said composite having an electrical resistivity value from 20 ohms/cmf to 400 ohms/cmf and a flexivity value from $90 \times 10^{-7}$ inches per inch per degree Fahrenheit to $110 \times 10^{-7}$ inches per inch per degree Fahrenheit.

8. A snap-acting thermostat metal member as set forth in claim 7 wherein said first preselected metallic alloy has a nominal composition by weight of about 25 percent nickel, 8.5 percent chromium and the balance iron and said second preselected metallic alloy has a nominal composition weight of about 40 percent nickel and the balance iron.

9. A snap-acting thermostat metal member as set forth in claim 8 wherein said intermediate layer is selected from the group consisting of high copper and nickel alloys.

* * * * *